United States Patent [19]

Sakagami

[11] 4,038,850

[45] Aug. 2, 1977

[54] METHOD OF AND APPARATUS FOR PRODUCING BASEBALL BATS

[75] Inventor: Mamoru Sakagami, Chiryu, Japan

[73] Assignee: Fuji Kikai Seizo Kabushiki Kaisha, Chiryu, Japan

[21] Appl. No.: 688,082

[22] Filed: May 19, 1976

[30] Foreign Application Priority Data

June 5, 1975 Japan ..... 50-68068

[51] Int. Cl.[2] ..... B21B 19/12; B21D 51/16

[52] U.S. Cl. ..... 72/85; 72/84; 72/367

[58] Field of Search ..... 273/72 A; 29/DIG. 41; 72/83, 85, 84, 367

[56] References Cited

U.S. PATENT DOCUMENTS

| | | | |
|---|---|---|---|
| 557,791 | 4/1896 | Findlay | 72/85 |
| 1,499,128 | 6/1924 | Shroyer | 273/72 A |

*Primary Examiner*—Lowell A. Larson

*Attorney, Agent, or Firm*—Browdy and Neimark

[57] ABSTRACT

The present invention enables the efficient production of integral baseball bats made of metal tubing by use of a unique process utilizing a forming machine without welding or joining individually processed portions, this process comprising substantially the following major steps:

the step of rotationally forming the body portion by pressing a plurality of spinning rollers of three or more in number synchronously on the tubing with a preformed mandrel inserted therein;

the step of rotationally forming the grip portion by urging another plurality of rollers against the tubing at the rear portion thereof after retracting the tailstock; and the step of rotationally forming the other end portion of the tubing which is re-chucked after an interruption of working followed by a turn-over of the tubing which has been removed from the mandrel.

3 Claims, 7 Drawing Figures

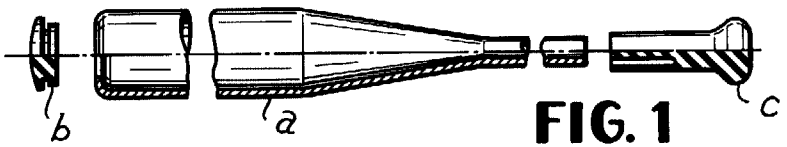
FIG. 1
CONVENTIONAL
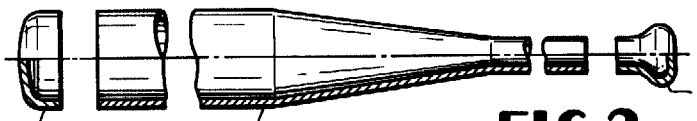
FIG. 2
CONVENTIONAL

METHOD OF AND APPARATUS FOR PRODUCING BASEBALL BATS

FIELD OF THE INVENTION

This invention relates to a method of producing integral baseball bats composed of a large end, a body portion, and a grip portion from a , single piece of metal tubing and an apparatus for producing the same.

BACKGROUND of the INVENTION

The conventional methods of manufacturing metal bats generally belong to either of the following two categories as illustrated on the appended FIGS. 1 and 2: (A) forming a bat by putting together a body portion (*a*), a large end (*b*), and a grip portion (*c*) made of metallic material, for example aluminum, with some kind of adhesive, wherein said body portion is formed by a swaging process, the large end is sealed with a rubber or plastic plug, and the grip portion is often covered with a knobbed rubber for preventing slippage; (B) forming a bat by welding together three metal pieces, the body portion (*a'*) formed by a swaging process, the large end (*b'*) and the grip portion (*c'*) formed by a swaging or drawing process. The metal bats as per (A) are not free from being broken into pieces by detachment of the attached portions while in use, and the body portion may be subjected to be struck away. The bats as per (B) are likewise non-integral in material, so that the bats are not only unreliable with regard to strength but are also liable to be of high cost in manufacturing because of the diversification of processes. In addition, the process by which the bats (B) are made is apt to invite unequality of wall thickness of the material and also inherent brittleness at the heat affected zones in the case of fabricated construction, which means the products are still problematical or insufficient in durability, and even dangerous in possibly hurting the players.

SUMMARY OF THE INVENTION

A primary object of this invention is, therefore, to provide a method of and an apparatus for producing an integral baseball bat from a single piece of material, eliminating the shortcomings stated above which have been inevitable in the conventional methods, without employing any kind of joining method or means.

More in particular, another object of this invention is to provide a method of producing integral metal baseball bats from a single piece of material comprising the following major three steps and an apparatus therefor: a first step for forming the body portion by chucking one end in a known manner of a single piece of integral metal tubing to the chuck of a forming machine, with a mandrel inserted therein, and guiding or supporting the other end of the tubing at the tailstock for imparting rotation to said tubing to be processed resulting in a rotational forming, that is a forming by synchronously pressing a plurality of rollers at least three in number thereagainst; a second step for forming the grip portion by applying a process of rotational forming or curling, that is also a kind of forming, to the other end portion of the tubing processed in the first step, after retracting the tail-end support of the tailstock, with another plurality of pressing rollers having a pre-formed concave configuration in vertical section thereof; and a third step for forming the large end of the bat, by re-chucking the work tubing, after taking out the mandrel from the work tubing followed by turning over the work tubing, to permit a rotational forming, on the large end with the first plurality of rollers synchronously pressed thereon, without the mandrel therein.

BRIEF DESCRIPTION OF THE DRAWINGS

With these objects in mind, reference is made to the attached drawings illustrating the embodiments of the invention in comparison with conventional ones and in which:

FIGS. 1 and 2 are respectively a general view showing bats, as examples, made by conventional methods, wherein the upper half is an elevational view and the lower half is a vertical cross-sectional view;

DESCRIPTION OF PREFERRED EMBODIMENTS

Figure 3:
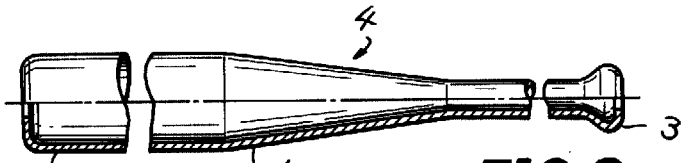
FIG. 3 is a general view of a bat made by an apparatus in accordance with this invention, wherein the upper half is likewise an elevational view and the lower half is in cross- section.

The following description of this invention is based upon the appended drawings FIGS. 3–7. FIG. 3 shows an integrally formed metal bat from a single piece of metal tubing made in accordance with the present invention by means of pressing with rollers to form a body portion 1, a large end 2, and a grip portion 3. The method of forming the bat 4 will now be explained referring to the manufacturing apparatus.

Figure 4:
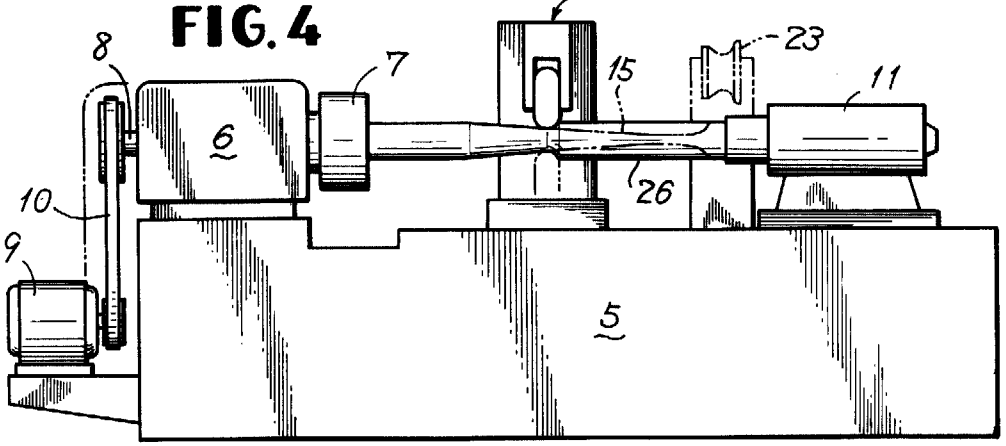
FIG. 4 is a general front view of an apparatus in accordance with this invention.
Figure 6:
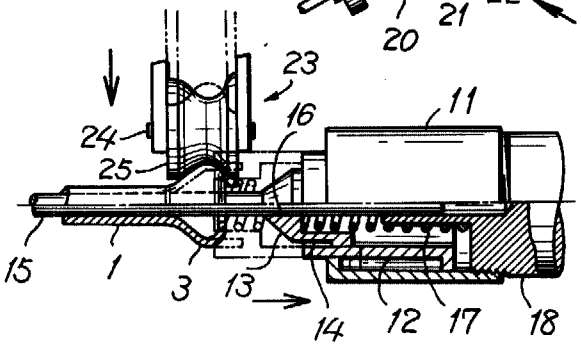
FIG. 6 is a fragmentary enlarged elevational view, partly in section, showing a forming device for the grip portion of the bat.

FIG. 4 shows a general view of the forming apparatus; the reference numeral 5 in the figure indicates a machine bed, 6 is a headstock of the machine for pivotably carrying a main shaft 8 provided with a chuck 7, the headstock being mounted on the bed for transferring rotation of the driving motor 9 via belt 10 to the main shaft 8. The reference numeral 11 represents a tailstock axially movably mounted on the bed 5 in confrontation with the headstock 6, and a tail-end support 12 disposed on the tailstock 11, shown in FIG. 6, is axially slidable relative to the tailstock 11. The tail-end support 12 is provided on the tip thereof with a tapered portion 13 for assisting in the formation of the grip portion 3, and an annular groove 14 for supporting the work end in order to prevent deformation thereof, and in the center with a hole 16 for guiding or receiving the extreme end of the mandrel 15. A spring 17 is disposed between the pedestal or base portion 18 of the tailstock 11 and the tail-end support 12 for continually biasing the tail-end support 12 toward the main shaft 8 or the work end.

The numeral 19 represents a synchronously moving roller forming device mounted on the bed 5 for synchronously pressing the work with three rollers acting vertically thereon, and disposed slidably in the lengthwise direction of the main shaft 8, the roller device 19 being provided with three actuators 20 each with its respective roller 21 movable normally to and away from the axis of the mandrel 15, i.e., each of said actuators 20 having the roller 21 on the outer end thereof pivoted thereto by a pin 22 which is disposed parallel to the axis of the main shaft 8. These three rollers are so arranged as to be actuated for pressing the work rubing during a synchronous stroke. The roller device 19 is movable along the axis of the mandrel 15 or the center line of the tubing on the bed 5, as illustrated in FIG. 6.

There is another synchronously moving roller device 23 for forming the grip portion showin in FIG. 6, mounted on the bed 5 comprising a pair of rollers 25 symmetrically arranged for pressing the other end of the work tubing to form the grip portion 3 of the bat 4. The pair of rollers 25 have a concave configuration in the cross section thereof and are respectively pivoted to a roller device 23 by a pin 24 disposed parallel to the axis of the main shaft 8, and are slidable in the vertical direction to and away from the axis of the work for synchronously pressing the other end of the work tubing to form the grip portion 3 of the bat 4.

The mandrel 15, having the contour substantially similar to that of the body portion of the bat to be produced is inserted for supporting the work tubing and for the forming thereof and is pulled out, after formation of the body portion, from the headstock side, that is the left side in the figures, through an opening disposed in the headstock 6 therethrough while the chuck 7 is holding the work tubing.

In the course of the forming process as described, after having completed the first and the second step of forming with the synchronously moving roller device 19 and a similar device 23, the mandrel 15 is pulled out followed by releasing of the work from the chuck 7 and re-chucking of the work for a third step of formation by means of the synchronously moving roller device 19 again.

Figure 5:
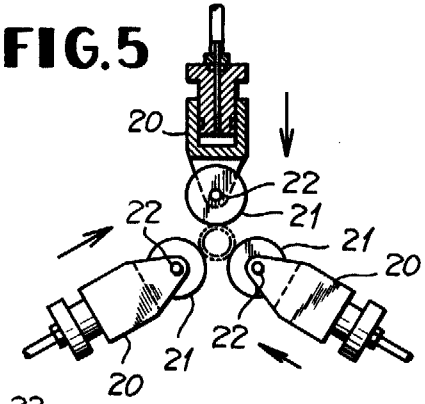
FIG. 5 is a side elevational view, partly in section, showing a synchronously moving roller device for forming provided with three rollers synchronously pressing the work.

The details of the forming method for bats employing the apparatus in accordance with this invention will be described hereinafter. The reference numeral 26 represents a length of metal tubing to be formed into a bat 4. This work tubing is chucked to the chucking device 7, with the mandrel 15 inserted therein, with the other end of the tubing being supported or guided by the tail-end support 12 of the tailstock 11. At this time the extreme right end of the mandrel 15 is accommodated in the hole 16 disposed in the tail-end support 12 to ensure proper supporting of the work tubing. When the motor 9 is energized in this state, the rotation thereof will be transferred via belt 10 to the chucked work tubing 26 and the mandrel lying partly in close contact therein, through the rotation of main shaft 8. Upon the stabilization of the rotation, the actuators 20 of the synchronously moving roller device 19 are started to synchronously press the work tubing for the rotational forming, from the three angles with the respective rollers 21 as best shown in FIG. 5, while slidably reciprocating along the axis of the tubing over the bed 5; this process of forming is continued until the tubing comes into close contact with the mandrel along the whole body portion thereof for completion of the forming of the portion 1 of bat 4, resulting in an extension of the length of the work tubing which is off-set by the tail- end support retraction against spring 17.

After having completed this first step for forming the body portion 1 by having completely copied the contour of the mandrel, the tail-end support 12 of the tailstock 11 is retracted a certain distance in the direction of the arrow in FIG. 6 for making way to another synchronously moving roller forming device 23 to advance; the device 23 which is provided with a pair of rollers of a pre-formed concave configuration in vertical section is pressed for spinning in the direction of the vertical arrow in FIG. 6 onto the other end of the tubing to form the grip portion 3 of the bat 4 by means of a curling or forming process.

Figure 7:
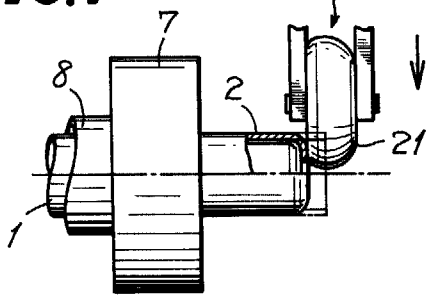
FIG. 7 is a fragmentary front view, partly in section, showing a forming device for the large end of the bat.

Upon having finished the second step, the machine is interrupted or stopped once for taking out the mandrel 15 from the tubing while the same is held in the headstock and the releasing and reversing the tubing; then the inverted tubing shall be re-chucked for the third step, as shown in FIG. 7, that is, only the large end portion to be processed appears on the right-hand side of the chuck 7, and the rest of the tubing already processed is lying to the left side through the opening disposed in the headstock 6. Then the machine is started again to apply the rotation to the large end portion of the tubing to be process with the synchronously moving roller device 19 containing the three rollers to give the final forming step for producing the finished metal bat 4.

As described heretofore in detail, a forming of an integral bat from a single piece of metallic tubing has been achieved in this invention by pressing a metal tubing into rotational contact with rotatable rollers, more particularly, by the combination of a plurality of reciprocating movements in the axial direction.

The invention is practically quite effective in producing metal bats because of its elimination of various shortcomings inevitable to the traditional metal but making methods such as: (*a*) frequent occurrence of coming apart of the body portion of the bat at the attached portions in the case of bats composed of parts jointed together with adhesives; (*b*) the number of parts used being relatively large; and (*c*) problems concerning the degradation of the heat affected zones in the case of bats which are welded together.

It will be obvious to those skilled in the art that various changes may be made without departing from the scope of the invention and the inventjon is not to be considered limited to what is shown in the drawing and described in the specification.

What is claimed is:

1. A method of producing an integral baseball bat having a body portion, a grip and a large end portion from a single piece of metal tubing having an axis, the method comprising the following steps, all steps being carried out without applying any heat to the tubing:

a. chucking said piece of metal tubing with a mandrel inserted therein at one end of said tubing by a chucking device of a headstock of a forming maching having a bed and axially movably supporting said tubing at the other end thereof by a tailstock of the machine, being defined radially in an annular groove, the mandrel having previously been formed substantially in accordance with desired contour of said body portion of said bat;

b. rotating said tubing to reproduce thereon the contour of said mandrel by a first forming step which includes pressing synchronously a first plurality of at least three rotatable rollers onto the outer surface of said rotating tubing while slidably reciprocating these rollers along said axis of said tubing along the bed of the machine to form said body portion of said bat;

c. retracting the tailstock a certain distance and advancing a second plurality of rotatable rollers of concave configuration in vertical section onto an end portion of said tubing to form said grip end of said bat by a second forming step, leaving an opening in its center to be able to withdraw the mandrel therethrough;

d. interrupting the rotation of said tubing, taking out the mandrel from said tubing, and re-chucking said tubing in order to form said large end portion of said bat; and e. thereafter forming said large end portion of said bat using the first plurality of rotatable rollers.

2. An apparatus for producing an integral baseball bat having a body portion, a grip and a large end portion from a single piece of metal tubing having a straight axis to be rotationally formed therefrom, the apparatus comprising:

a. a chucking device rotatably supported by a headstock mounted on a machine bed for chucking the metal tubing;

b. a mandrel which is formed substantially similar to a configuration of the body portion of the bat to be inserted into the tubing and able to be chucked by said chucking device to rotate with the tubing;

c. a first roller device having a first plurality of rotatably forming rollers, each supported by a respective actuator, said rollers of said first roller device being synchronously and normally movable to and away from the axis of the tubing by said actuators;

d. means for moving said first roller device along the length of the piece of metal tubing so that said rollers of said first roller device forms a portion of the tubing into a configuration defined by said mandrel;

e. a second roller device having a second plurality of rotatable forming rollers with a concave configuration in the cross-section thereof respectively, said rollers of said second roller device being movable synchronously and perpendicularly to and away from the axis of the tubing; and f. an axially movable tailstock provided with a tail-end support, further axially movable therefrom, including a tapered portion for assisting in formation of the grip portion, an annular groove for supporting an end of the tubing, and a spring member disposed between said tailstock and said tail- end support for continually biasing said tail-end support toward the end of the tubing.

3. An apparatus according to claim 2, wherein said first roller device includes at least three rollers.

* * * * *